United States Patent [19]

Matson

[11] Patent Number: 4,658,918

[45] Date of Patent: Apr. 21, 1987

[54] THREADED NOZZLE FOR A DRILL BIT

[75] Inventor: Lawrence W. Matson, League City, Tex.

[73] Assignee: Strata Bit Corporation, Houston, Tex.

[21] Appl. No.: 758,888

[22] Filed: Jul. 25, 1985

[51] Int. Cl.[4] ..... E21B 10/18

[52] U.S. Cl. ..... 175/423; 175/393; 411/1; 411/403

[58] Field of Search ..... 175/339, 340, 393, 422 R; 299/17, 81; 411/6, 7, 8, 402, 2, 3, 4, 5, 911, 1, 403

[56] References Cited

U.S. PATENT DOCUMENTS

| | | | |
|---|---|---|---|
| 2,244,124 | 6/1941 | Shemeley | 285/39 |
| 3,134,292 | 5/1964 | Walton | 411/403 |
| 3,178,988 | 4/1965 | Borup | 411/403 |
| 3,854,372 | 12/1974 | Gutshall | 411/402 X |
| 4,372,399 | 2/1983 | Cork | 175/422 R X |
| 4,381,825 | 5/1983 | Radtke | 175/393 |
| 4,400,024 | 8/1983 | Ratcliff et al. | 175/340 X |
| 4,437,707 | 3/1984 | Best et al. | 175/393 X |
| 4,492,500 | 1/1985 | Ewing | 411/5 |

FOREIGN PATENT DOCUMENTS

| | | | |
|---|---|---|---|
| 477773 | 10/1951 | Canada | 411/403 |
| 645711 | 10/1928 | France | 411/402 |
| 653961 | 3/1929 | France | 411/402 |
| 965038 | 4/1950 | France | 411/402 |
| 1223900 | 3/1971 | United Kingdom | 411/402 |

*Primary Examiner*—James A. Leppink
*Assistant Examiner*—Michael A. Goodwin
*Attorney, Agent, or Firm*—Burns, Doane, Swecker & Mathis

[57] ABSTRACT

A threaded nozzle is adapted to be screwed into and screwed out of a threaded opening in a drill bit. The nozzle includes a front face having first and second contact surfaces which are adapted to be engaged by a manually actuable tool for screwing-in and screwing-out the nozzle. The first contact surface is inclined toward the direction of rotation in which the member is screwed-in, so that in response to the application of a force to the first contact surface for screwing-in the nozzle, a reaction force is applied against the tool for pushing the tool off the first contact surface when the nozzle has been screwed-in a predetermined extent.

7 Claims, 5 Drawing Figures

Fig. 1
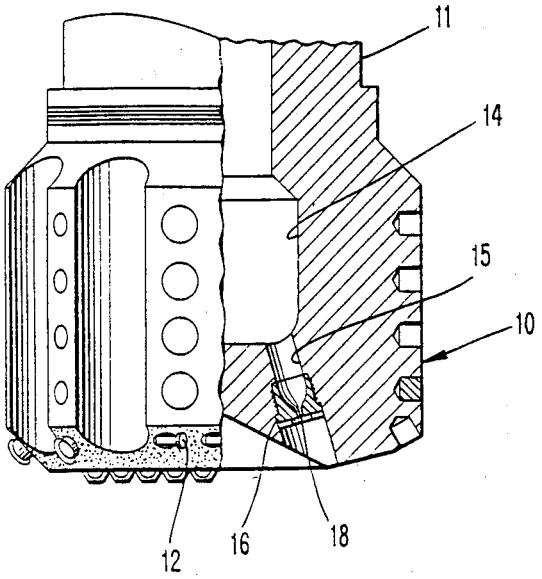
Fig. 2
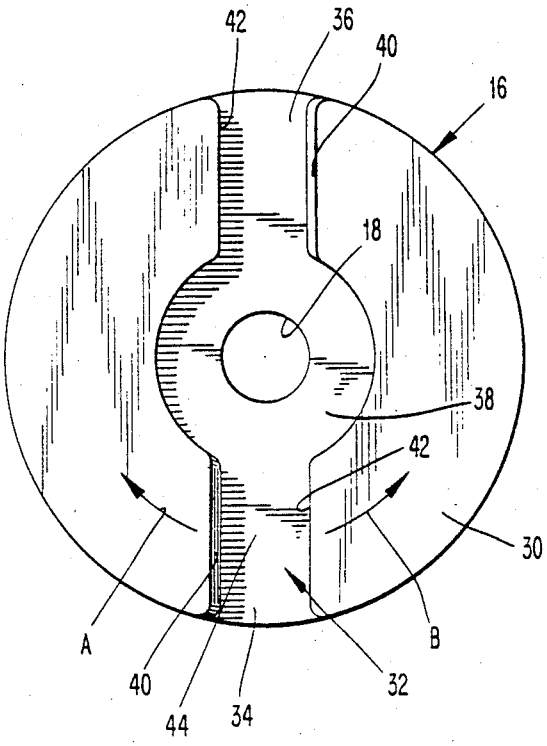
Fig. 3
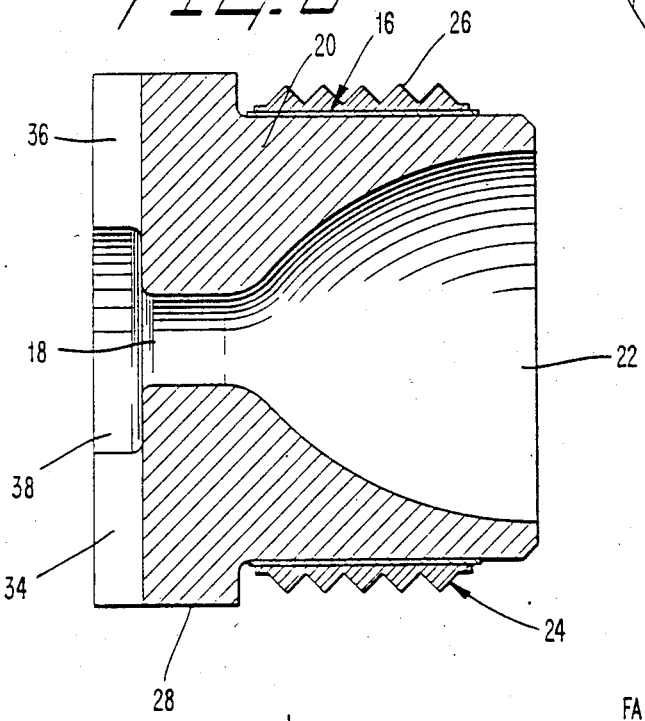
Fig. 4
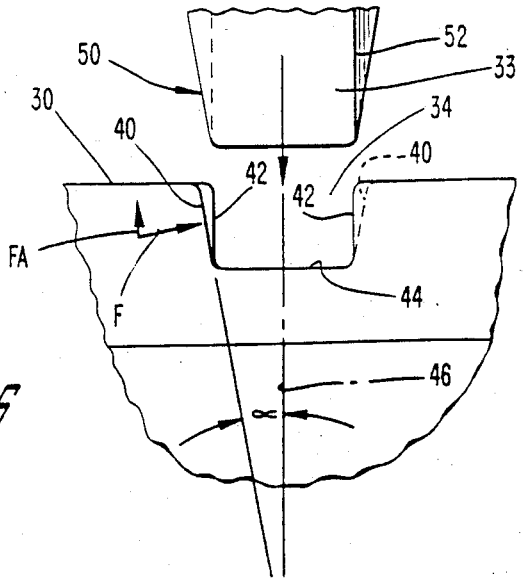
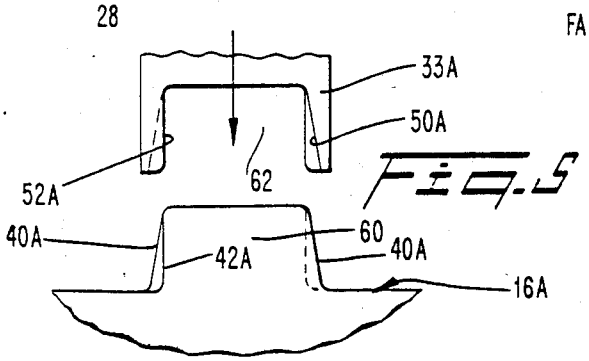
Fig. 5

THREADED NOZZLE FOR A DRILL BIT

BACKGROUND AND OBJECTS OF THE INVENTION

The present invention relates to fluid nozzles and, in particular, to hydraulic jet drilling wherein high-speed streams of fluid are emitted from nozzles mounted on the drill bit.

In a typical rotary drilling operation, a rotary drill bit is rotated while being advanced into a soil or rock formation. The soil or rock is cut by cutting elements on the drill bit, and these cuttings are flushed from the borehole by the circulation of drilling fluid toward the top of the hole. The drilling fluid is delivered to the drill bit downwardly through a passage in the drill stem and is ejected outwardly through nozzles disposed in the face of the drill bit. The ejected drilling fluid is directed outwardly through the nozzles at high speed (e.g., at 100 feet/sec. or greater) to aid in cutting of the rock and cooling of the drill bit.

In Radtke U.S. Pat. No. 4,381,825 issued May 3, 1983, nozzles are removably secured within a bore in the drill bit face. Preferably, the nozzles are attached in a readily replaceable manner, such as by means of a threaded connection between the nozzles and the bores in which they are positioned.

One problem which has arisen concerns the difficulty in replacing worn nozzles if the nozzles have been originally screwed-in with excessive force. Since the nozzles are normally manually screwed-in with a hand tool, it is difficult to control the amount by which the nozzle is tightened. Excessive tightening may cause the threads to bind and thereby cause extraction thereof to become excessively difficult.

It is, therefore, an object of the present invention to minimize or obviate problems of the type discussed above.

A further object is to prevent a nozzle from being excessively tightened.

An additional object is to provide a threaded member, such as a drill bit nozzle, which limits the amount by which it can be tightened.

SUMMARY OF THE INVENTION

These objects are achieved by the present invention which relates to a threaded member, such as a nozzle, which is adapted to be engaged by a manually actuable tool for being screwed-in and screwed-out of a mounting structure, such as a drill bit. The member comprises a body having helical threads adapting the body to be threadedly connected with corresponding helical threads on the mounting structure by being rotated about a longitudinal axis of rotation. A front face on the body includes at least one first contact surface and at least one second contact surface. Those surfaces are engageable by tool surfaces of the manually actuable tool and are arranged such that a force applied to the first contact surface causes the member to be screwed-in, and a force supplied to the second contact surface causes the member to be screwed-out. The second contact surface extends longitudinally forwardly in such manner as to be disposed substantially parallel to the axis of rotation. The first contact surface extends longitudinally forwardly in such manner as to be inclined toward the direction of rotation in which the member is screwed-in, so that in response to the application of a force to the first contact surface for screwing-in the member, a longitudinally forward reaction force is applied against the tool for pushing the tool off the first contact surface when the member has been screwed-in to a predetermined extent.

As a result, the member resists being excessively tightened and will thus be able to be unscrewed for replacement.

BRIEF DESCRIPTION OF THE DRAWINGS

The objects and advantages of the invention will become apparent from the following detailed description of preferred embodiments thereof, in connection with the accompanying drawings in which like numerals designate like elements, and in which:

FIG. 1 is a side elevational view, partly in cross-section of a drill bit containing a threaded nozzle;

FIG. 2 is a front view of a nozzle according to the present invention;

FIG. 3 is a longitudinal sectional view taken through the nozzle;

FIG. 4 is an enlarged side elevational view of a slot formed in a front face of the nozzle and depicting the end of a manually actuable tool approaching the slot; and FIG. 5 is a view similar to FIG. 4 depicting a modified form of the invention and a modified form of the actuating tool.

DETAILED DESCRIPTION OF A PREFERRED EMBODIMENT OF THE INVENTION

Depicted in FIG. 1 is a rotary drill bit 10 mounted at the end of a drill stem 11. A plurality of cutting elements 12 are fastened in the face of the drill bit for cutting away a rock or earth formation as the drill bit is rotated.

A plurality of nozzles 16 are mounted in the face of the drill bit for discharging high-speed jets of drilling fluid against the bottom of the borehole being cut. The drilling fluid is conducted to the nozzles through a passage 14 in the drill stem which communicates with bore-type cavities 15 in the drill bit. The nozzles 16 are threadedly secured at the outer ends of these bores and each include a discharge or jet opening 18 through which the drilling fluid is discharged. The jet streams aid in the cutting of the formation, cooling of the drill bit cutters, and carrying of the cuttings to the top of the borehole in the annular space between the drill stem and the borehole wall.

A nozzle constructed in accordance with the present invention is depicted in FIGS. 2–4. The nozzle includes a body portion 20 having a central jet opening 18 which communicates with a larger inner cavity 22. The body 20 is preferably formed of a hard material such as tungsten carbide. A sleeve 24 which carries male threads 26 is brazed to the body 20. Alternatively, the threads could be formed directly in the body 20. The body includes an enlarged flange 28 at its front or outer end, which flange overlies and protects the threads from erosion by abrasive particles during a drilling operation.

Formed in a front face 30 of the body 20 is a diametrical slot 32 into which a manual tool 33 or the like can be inserted in order to rotate the body to screw the threads 26 into the female threads of the drill bit, or back the nozzle out of such female threads.

The slot 32 includes a pair of recesses 34, 36 which are interconnected by a circular groove 38 that communicates with the jet opening 18. Each of the recesses 34, 36 includes pairs of first and second contact surfaces 40, 42 which are generally radially oriented as viewed in the longitudinal direction (FIG. 2), and a base surface 44 interconnecting the first and second contact surfaces. The first contact surfaces 40 extend longitudinally forwardly from the base surface 44 while leaning toward the direction of tightening rotation of the nozzle (FIG. 4). That is, by applying a force to the first contact surfaces 40, the nozzle will be rotated in a direction A (FIG. 2) for causing the nozzle to be screwed into a female thread (as opposed to being backed-out of such a thread). The second contact surfaces 42 are oriented parallel to the central axis 46 of the nozzle and are arranged so that a force applied thereto will tend to produce rotation of the nozzle in a direction B causing the nozzle to be loosened or backed-out of a female thread.

The angle $\alpha$ which the front surface 40 forms with the central axis 46 can vary, but is preferably in the range of from 9 to 12 degrees and most preferably is 10 degrees.

The tool 33 is shaped in corresponding fashion to the slot 32. That is, at each end, the tool includes a front wall 50 adapted to engage flushly the first contact surface 40 of the respective recess, and a back wall 52 adapted to engage flushly the second contact surface 42 of the recess. The front wall 50 is thus inclined relative to the central axis 46 in corresponding fashion to the first contact surface 40, and the back wall 52 is parallel to such axis 46.

It will be appreciated that when the tool 33 is inserted into the slot 32 and rotated in the forward or tightening direction A, the threads 26 of the nozzle will be inserted into the female threads of the drill bit. Since the first contact surface 40 and the front wall 50 each lean forwardly, reaction force F acting upon the front wall 50 will include a component FA in the longitudinally forward direction, the magnitude of which component is a function of the magnitude of the turning forces and the size of the angle $\alpha$. Such a component acts in a manner tending to push the tool out of the slot 32. As the nozzle begins to become tightened, the turning force increases, thereby increasing the magnitude of the push-out component FA. When the nozzle has been tightened to a certain predetermined extent, the push-out force will be great enough to push the tool out of the slot. (It is assumed, of course, that only nominal longitudinal forces are being applied to the tool tending to push the tool within the slot and which can thus be overcome by the push-out component.) In this way, the extent to which the nozzle can be tightened is self-limiting by the nozzle.

When the tool 33 is rotated in the reverse direction B, there occurs no component tending to push the tool out of the slot. Therefore, maximum reverse forces can be applied for unscrewing the nozzle.

The range of 9 to 12 degrees for the angle $\alpha$ has been found to produce preferable results, although angles outside that range might be suitable.

As an alternative to employing a slot in the nozzle, the nozzle 16A could be provided with projections 60, as shown in FIG. 5, and the tool 33A could be provided with corresponding slots 62. The tool would function in the same manner described above in connection with FIGS. 2–4. That is, as front walls 50A of the tool 33A engage inclined first contact surfaces 40A of the projections 60, the nozzle is tightened until the push-out component forces the tool off the projection. Unscrewing of the nozzle is achieved by engaging the back walls 52A against the non-inclined second contact surfaces 42A of the projection.

IN OPERATION, the nozzle 16 is inserted into the drill bit 10 by being screwed into a threaded opening therein. This is achieved by inserting the nose of the tool 33 into the slot 32 of the nozzle. The front wall 50 at each end of the tool nose contact a respective first contact surface 40 of the nozzle. As the tool is rotated in the direction A for tightening the nozzle, reaction forces F are applied against the front faces 50 of the tool which tend to urge the tool in a longitudinally forward direction, i.e., out of the slot 32. Screwing-in of the nozzle proceeds until the nozzle is tightened to a predetermined extent, at which time the magnitude of the reaction forces acting upon the tool are increased so as to cause the tool to slide along the first contact surfaces 40 until the tool has been displaced off those surfaces 40. As a result, the nozzle itself resists being excessively tightened, thus promoting subsequent unscrewing of the nozzle for replacement purposes.

Although the present invention has been described in connection with a preferred embodiment thereof, it will be appreciated by those skilled in the art that additions, modifications, substitutions, and deletions not specifically described, may be made without departing from the spirit and scope of the invention as defined in the appended claims.

What is claimed is:

1. A threaded nozzle adapted to be engaged by a manually actuable tool for being screwed-in and screwed-out of a drill bit, said nozzle comprising:

a body having a fluid-conducting jet opening and helical threads adapting said nozzle to be threadedly connected with corresponding helical threads on a drill bit by being rotated about a longitudinal axis of rotation, and a front face on said body including at least one first contact surface and at least one second contact surface, said contact surfaces being engageable by tool surfaces of a manually actuable tool and being arranged such that a force applied to said first contact surface causes said nozzle to be screwed-in, and a force applied to said second contact surface causes said nozzle to be screwed-out, said first and second contact surfaces being disposed at differeent angular relationships relative to said axis of rotation such that:

said second contact surface extends longitudinally forwardly in such manner as to be disposed substantially parallel to said axis of rotation, said first contact surface extends longitudinally forwardly in such manner as to be inclined toward the direction of rotation in which said nozzle is screwed-in so that in response to the application of a force to said first contact surface for screwing-in said nozzle, a longitudinally forward reaction force is applied against the tool for pushing the tool off said first contact surface when said nozzle has been screwed-in to a predetermined extent.

2. A member according to claim 1, wherein there are two said first contact surfaces and two said second contact surfaces.

3. A member according to claim 2, wherein said first and second contact surfaces form portions of a diametrical slot in said front face.

4. A member according to claim 2, wherein said first and second contact surfaces form portions of a diametrical projection extending forwardly from said front face.

5. A member according to claim 1, wherein said first contact surface forms an angle of from 9 to 12 degrees relative to said axis of rotation.

6. A member according to claim 5, wherein said angle is 10 degrees.

7. A nozzle according to claim 1, wherein said helical threads on said nozzle comprise male threads.

* * * * *